US010771886B2

(12) United States Patent
Han

(10) Patent No.: US 10,771,886 B2
(45) Date of Patent: Sep. 8, 2020

(54) HEADPHONE STRUCTURE FOR EXTENDING AND ENHANCING RESONANCE

(71) Applicant: Tai-Sheng Han, New Taipei (TW)

(72) Inventor: Tai-Sheng Han, New Taipei (TW)

(73) Assignee: EVGA CORPORATION, New Taipei (TW)

( * ) Notice: Subject to any disclaimer, the term of this patent is extended or adjusted under 35 U.S.C. 154(b) by 22 days.

(21) Appl. No.: 16/246,138

(22) Filed: Jan. 11, 2019

(65) Prior Publication Data

US 2020/0228890 A1 Jul. 16, 2020

(51) Int. Cl.
*H04R 5/033* (2006.01)
*H04R 1/10* (2006.01)
*H04R 1/28* (2006.01)

(52) U.S. Cl.
CPC ..... *H04R 1/1075* (2013.01); *H04R 1/1008* (2013.01); *H04R 1/2811* (2013.01)

(58) Field of Classification Search
CPC . H04R 1/1008; H04R 1/2819; H04R 2201/10
See application file for complete search history.

(56) References Cited

U.S. PATENT DOCUMENTS 4,041,256 A * 8/1977 Ohta ..... H04R 1/1058 381/373
4,058,688 A * 11/1977 Nishimura ..... H04R 1/1008 381/372
4,239,945 A * 12/1980 Atoji ..... H04R 1/2819 381/349
4,965,836 A * 10/1990 Andre ..... H04R 1/1008 181/129
7,983,438 B2 * 7/2011 Tsunoda ..... H04R 1/1008 381/371
8,582,796 B2 * 11/2013 Kimura ..... H04R 1/1008 2/209
8,934,638 B2 * 1/2015 Kimura ..... G10K 11/17857 381/71.6

(Continued)

FOREIGN PATENT DOCUMENTS

JP H0536991 U * 5/1993 ..... H01R 1/1083
JP 2009010485 A * 1/2009
JP 6115947 B2 * 4/2017

*Primary Examiner* — Fan S Tsang
*Assistant Examiner* — Ryan Robinson
(74) *Attorney, Agent, or Firm* — Che-Yang Chen; Law Office of Michael Chen

(57) ABSTRACT

The present invention provides a headphone structure for extending and enhancing resonance comprising a main body, a cover and a shield. The main body has an accommodating portion for accommodating a speaker, a plurality of master sound guiding holes are penetrated in the accommodating portion and a plurality of side sound guiding holes are penetrated in the main body. A rear cavity space is formed between the cover and the main body, and the shield forms a rear cavity extending space to communicate with the side sound guiding holes and the rear cavity space. Thereby, the headphone structure can reduce air damping through the rear cavity extending space communicating with the rear cavity space, so as to achieve effects of increasing stroke displacement of the speaker and reducing air suppression of sound.

5 Claims, 7 Drawing Sheets

(56) References Cited

U.S. PATENT DOCUMENTS

| | | | | |
|---|---|---|---|---|
| 9,100,745 | B2 * | 8/2015 | Oishi | H04R 1/1041 |
| 9,602,912 | B2 * | 3/2017 | Wen | H04R 1/24 |
| 10,171,905 | B2 * | 1/2019 | Wen | H04R 1/1075 |
| 2019/0314207 | A1 * | 10/2019 | Bui | A61F 11/14 |
| 2020/0077171 | A1 * | 3/2020 | Chi-Hsueh | H04R 1/1091 |
| 2020/0077172 | A1 * | 3/2020 | England | H04R 1/288 |

* cited by examiner

HEADPHONE STRUCTURE FOR EXTENDING AND ENHANCING RESONANCE

BACKGROUND OF THE INVENTION

Field of Invention

The present invention relates to a headphone structure for extending and enhancing resonance.

Related Art

According to the advancement of technology, people are more and more accustomed to using mobile devices such as mobile phone and tablet to listen to music or watch videos. In order to let users listen to music or watch videos without disturbing others, headphone has already become a necessary accessory for personal mobile devices. Currently, headphones on the market are mainly divided into over-ear headphone, ear-hook headphone and in-ear headphone. The main structure of the general headphones includes a casing, a speaker unit and a front shield of each side. Wherein the speaker unit is disposed in the casing, and the front shield is disposed on one side of the casing and is used for attaching the ear. Generally, the larger the diameter of the speaker unit, the better the performance of the headphone. Among the above various headphones, the diameter of the driving unit of the over-ear headphone is the largest, and the diameters of the driving units of the in-ear headphone and the in-ear headphone are the smallest. In addition, the cavity space inside the headphone is also one of the emphases of performance. At present, headphones mainly use the cavity space of the casing to enable the speaker unit to generate amplitude and reflect the sound, but the design of headphones is limited in shape and volume, so the size of the cavity space of the casing is limited and the air resistance in compression of the speaker unit is large, relatively resulting in a small stroke displacement amplitude of the speaker unit and increase of the air suppression of sound, and therefore can not transmit full audio effects and provide full acoustic experience.

Therefore, how to improve the above-mentioned drawbacks is the technical difficulty that the inventor of the present invention wants to solve.

SUMMARY OF THE INVENTION

Therefore, in order to effectively solve the above problems, a primary object of the present invention is to provide a headphone structure for extending and enhancing resonance that reduces air damping to increase stroke displacement of a speaker unit and reduces air suppression of sound.

According to the object of the present invention, the present invention provides a headphone structure for extending and enhancing resonance. The headphone structure comprises a main body, a cover and a shield, wherein the main body is formed with an accommodating portion at a position of one side, a speaker is disposed in the accommodating portion, the main body is formed with a plurality of master sound guiding holes in the accommodating portion, and the main body is formed with a plurality of side sound guiding holes at positions of a side edge around the accommodating portion. The cover is disposed at an edge of a rear side of the main body, and a rear cavity space is formed between the cover and the main body to communicate with the side sound guiding holes. The shield has an outer ring portion and an inner ring portion connected to each other for assembling with a front side of the main body, a front cavity space is formed by the inner ring portion of the shield, a rear cavity extending space is formed between the outer ring portion and the inner ring portion, and the rear cavity extending space communicates with the side sound guiding holes and the rear cavity space. Thereby the headphone structure can reduce the air damping through the rear cavity extending space communicating with the rear cavity space, so as to achieve effects of increasing stroke displacement of the speaker and reducing air suppression of sound.

According to an embodiment of the headphone structure of the present invention, wherein the main body is formed with at least one shield interlocking portion and at least one cover interlocking portion on both sides respectively.

According to an embodiment of the headphone structure of the present invention, wherein the master sound guiding holes are formed in the accommodating portion and correspond to the speaker, and the side sound guiding holes are intervally formed and surround the accommodating portion.

According to an embodiment of the headphone structure of the present invention, wherein an edge of the inner ring portion is formed with an inner ring interlocking portion, an edge of the outer ring portion is formed with an outer ring interlocking portion, and the inner ring interlocking portion as well as the outer ring interlocking portion are assembled with the shield interlocking portion and fix the shield on the front side of the main body.

According to an embodiment of the headphone structure of the present invention, wherein an edge of the cover is assembled with the cover interlocking portion and fixed to the rear side of the main body.

According to an embodiment of the headphone structure of the present invention, wherein the main body is composed of a front fixing member and a rear fixing member.

According to an embodiment of the headphone structure of the present invention, wherein the shield interlocking portion is formed on one side edge of the front fixing member, the front fixing member is formed with a plurality of convex portions at positions on another side opposite to the shield interlocking portion, and the front fixing member is penetrated with the side sound guiding holes.

According to an embodiment of the headphone structure of the present invention, wherein the accommodating portion and the cover interlocking portion are formed on one side of the rear fixing member, and the rear fixing member is penetrated with a plurality of holes and the side sound guiding holes.

DETAILED DESCRIPTION OF THE INVENTION

Figure 1:
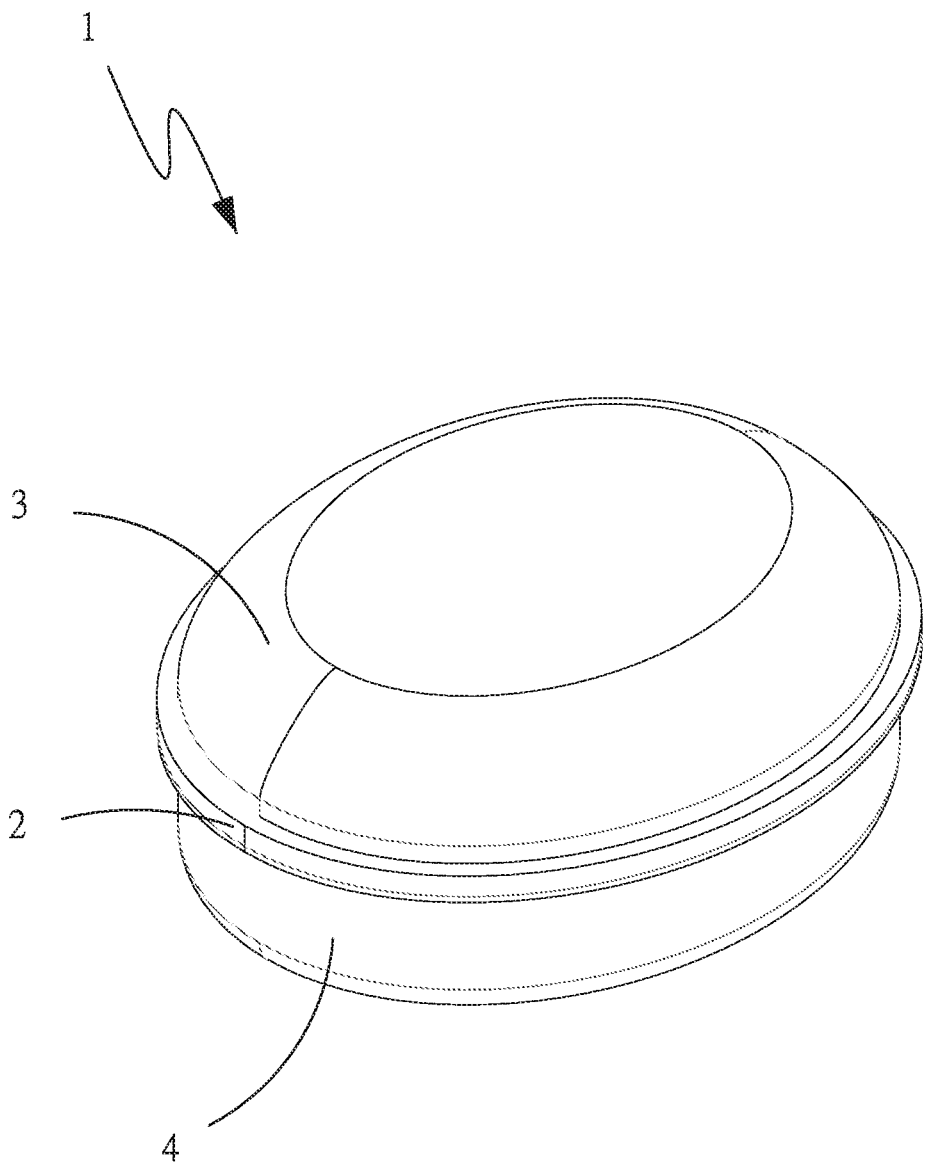
FIG. 1 is a perspective assembled view of a headphone structure of the present invention.
Figure 2:
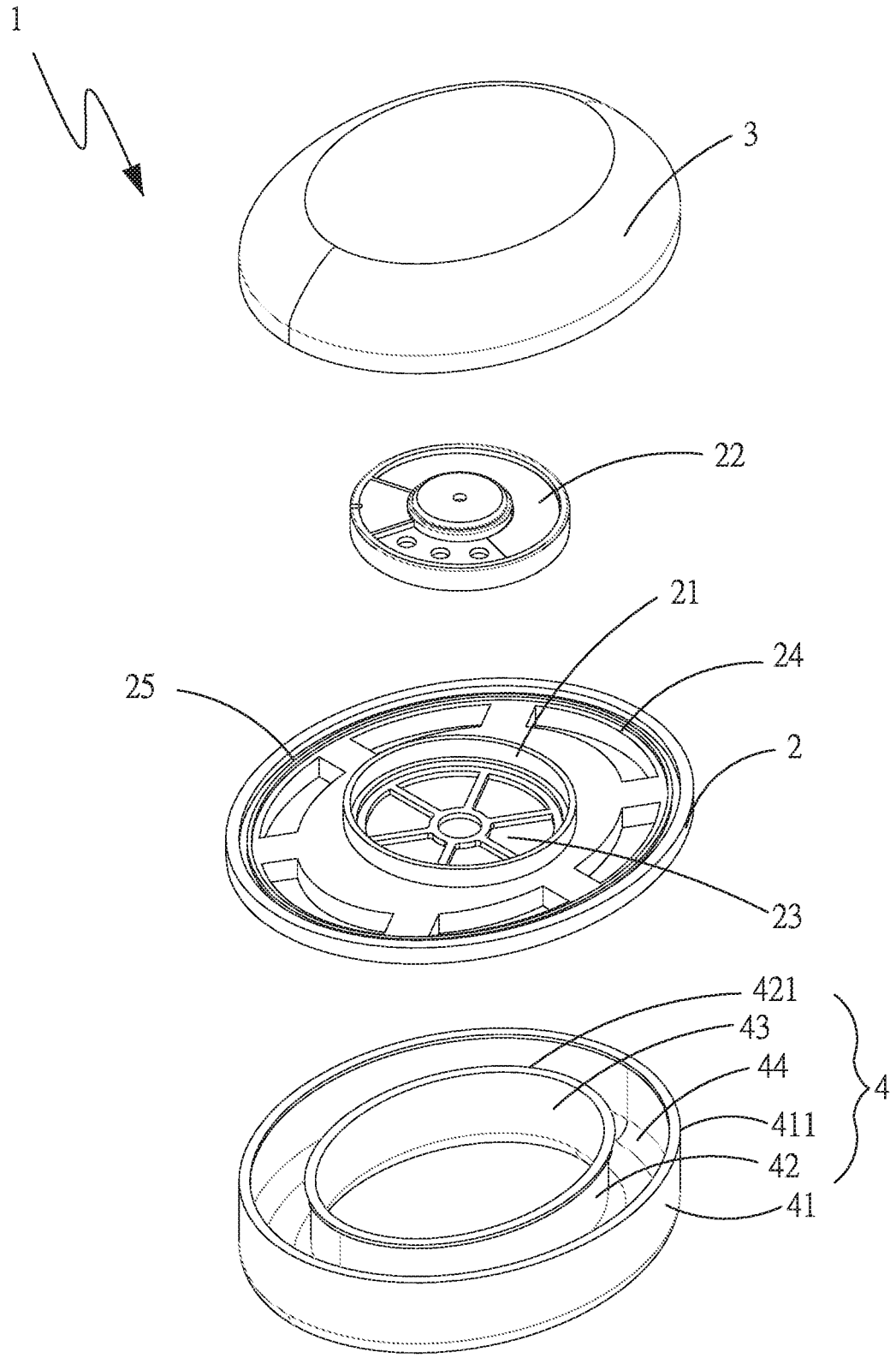
FIG. 2 is a perspective exploded view of the headphone structure of the present invention.
Figure 3:
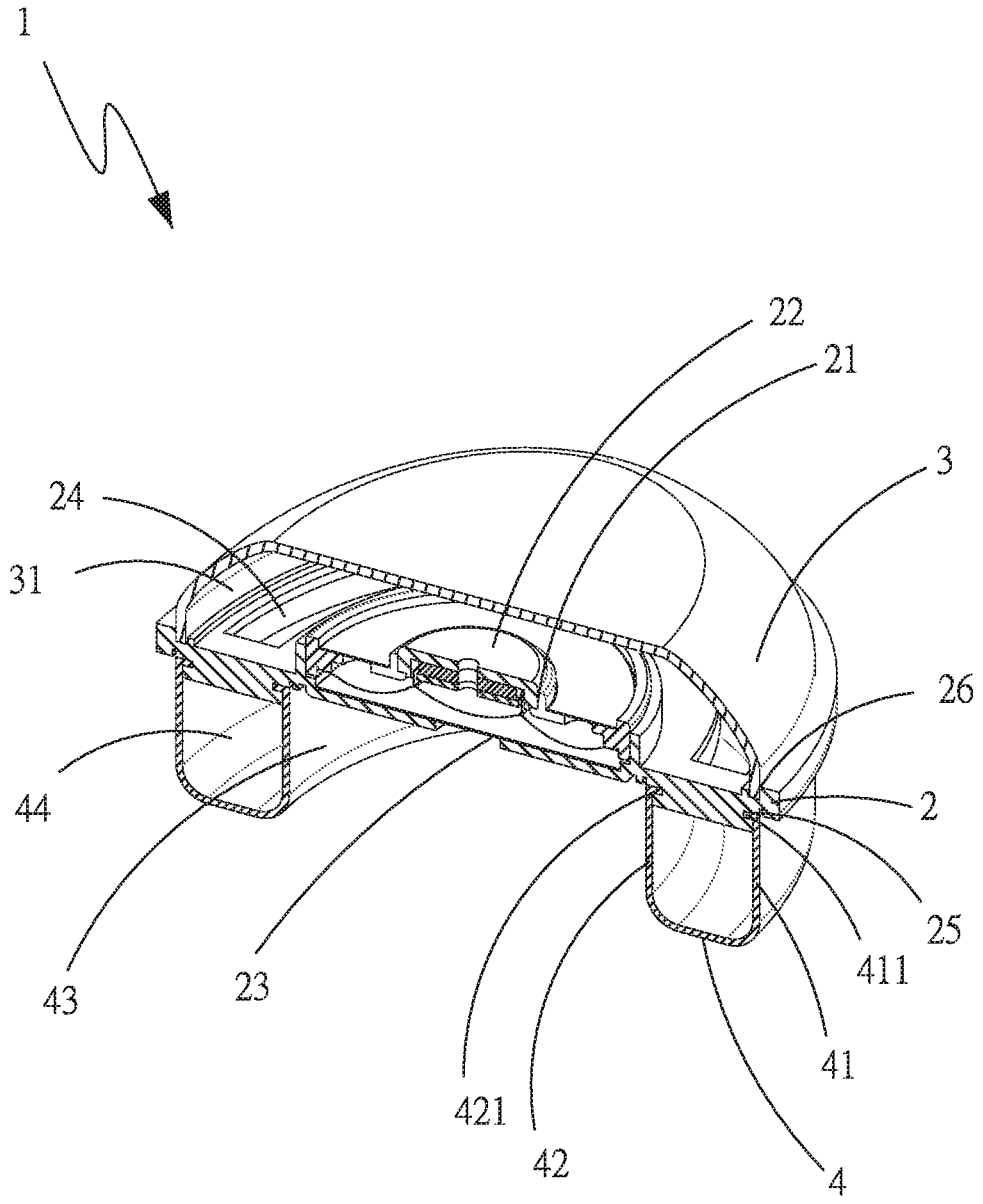
FIG. 3 is a perspective cross-sectional view of the headphone structure of the present invention.
Figure 4:
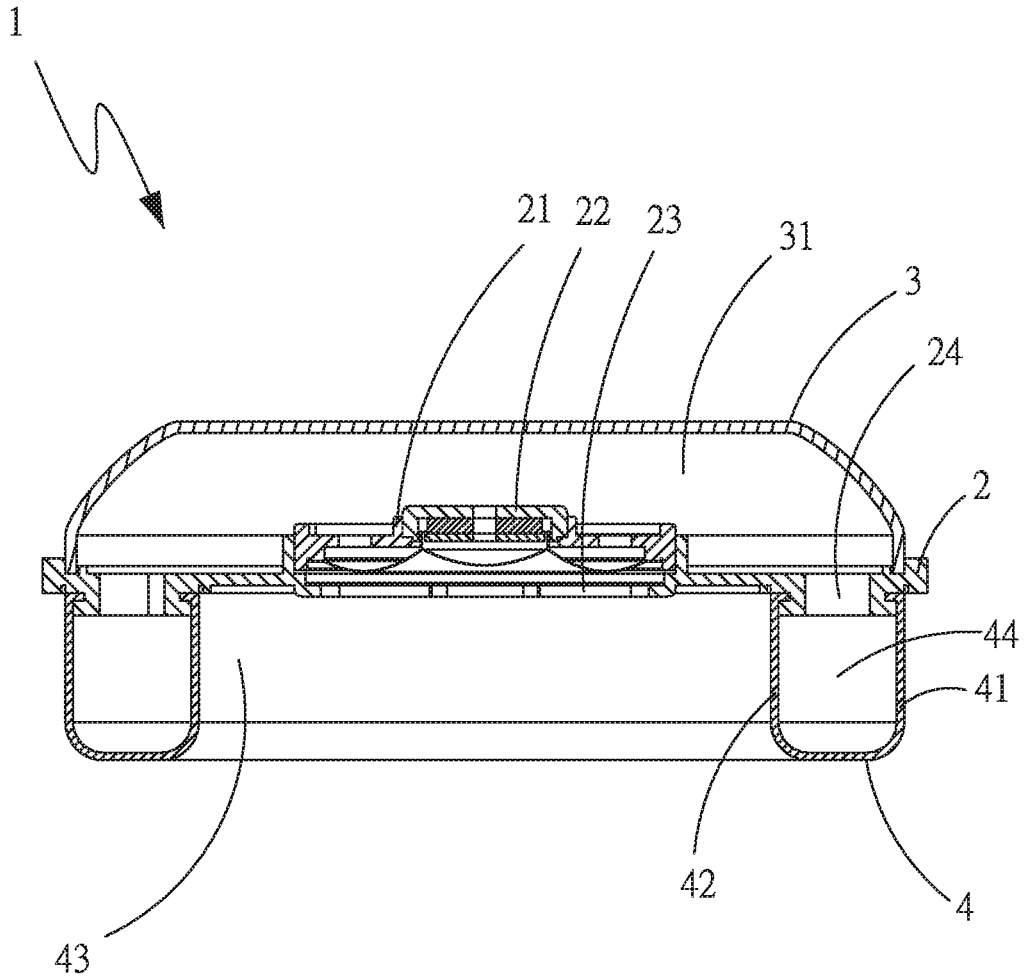
FIG. 4 is a plane cross-sectional view of another angle of the headphone structure of the present invention.

Please refer to FIG. 1 to FIG. 4, which are perspective assembled view, perspective exploded view, perspective cross-sectional view and plane cross-sectional view of another angle of a headphone structure of the present invention. It can be clearly seen from the figures that a headphone structure 1 includes a main body 2, a cover 3 and a shield 4, wherein the main body 2 is protrudingly formed with an accommodating portion 21 at a position of a rear side, and a speaker 22 is disposed in the accommodating portion 21 of the main body 2. The main body 2 is penetrated with a plurality of master sound guiding holes 23 and a plurality of side sound guiding holes 24, the master sound guiding holes 23 are formed in the accommodating portion 21 and correspond to the speaker 22, the side sound guiding holes 24 are intervally formed and surround the accommodating portion 21, and the main body 2 is formed with at least one shield interlocking portion 25 and at least one cover interlocking portion 26 on a front side edge and the rear side edge, respectively.

Wherein the cover 3 is disposed on the rear side of the main body 2, a rear cavity space 31 is formed between the cover 3 and the main body 2, the rear cavity space 31 communicates with the side sound guiding holes 24, and an edge of the cover 3 is assembled with the cover interlocking portion 26 and fixed to the rear side of the main body 2.

The shield 4 is disposed at a position of the front side of the main body 2. The shield 4 can be formed by plastic injection or vacuum forming or hot press forming, and a material thereof for forming can be rubber, silicone rubber, plastic, foam, leather or fabric composition. The shield 4 has an outer ring portion 41 and an inner ring portion 42. A front cavity space 43 is formed by the inner ring portion 42 of the shield 4, the outer ring portion 41 and the inner ring portion 42 of the shield 4 are interconnected and a rear cavity extending space 44 is formed in-between, and the rear cavity extending space 44 correspondingly communicates with the side sound guiding holes 24. An inner ring interlocking portion 421 is formed at an edge of the inner ring portion 42, an outer ring interlocking portion 411 is formed at an edge of the outer ring portion 41, and the inner ring interlocking portion 421 and the outer ring interlocking portion 411 are assembled with the shield interlocking portion 25 and fix the shield 4 on the front side of the main body 2.

Figure 5:
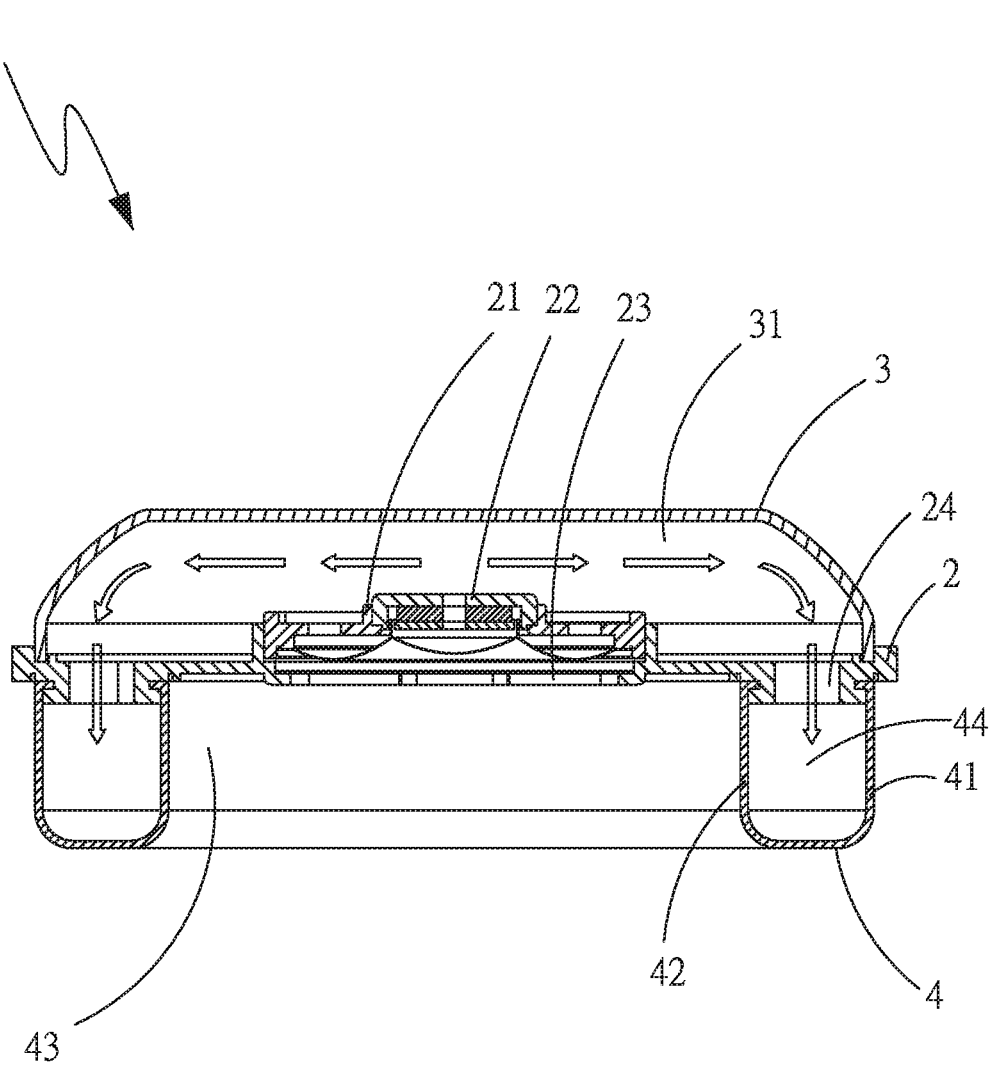
FIG. 5 is a schematic view of implementation of the headphone structure of the present invention.

Referring to the foregoing drawings and FIG. 5, which is a schematic view of implementation of the headphone structure of the present invention. Wherein the rear cavity space 31 of the headphone structure 1 communicates with the side sound guiding holes 24 and the rear cavity extending space 44 to enable the headphone structure 1 to increase its overall cavity space. While the cavity space is increased, the air compression resistance in the headphone structure 1 can be made smaller, and when the speaker 22 receives a sound source and generates vibration, stroke displacement of the speaker 22 can be effectively enhanced. With the cavity space being increased, air suppression of sound in the headphone structure 1 can be reduced, thereby achieving the headphone structure 1 being effectively capable of transmitting full audio effects and providing full acoustic experience.

Figure 6:
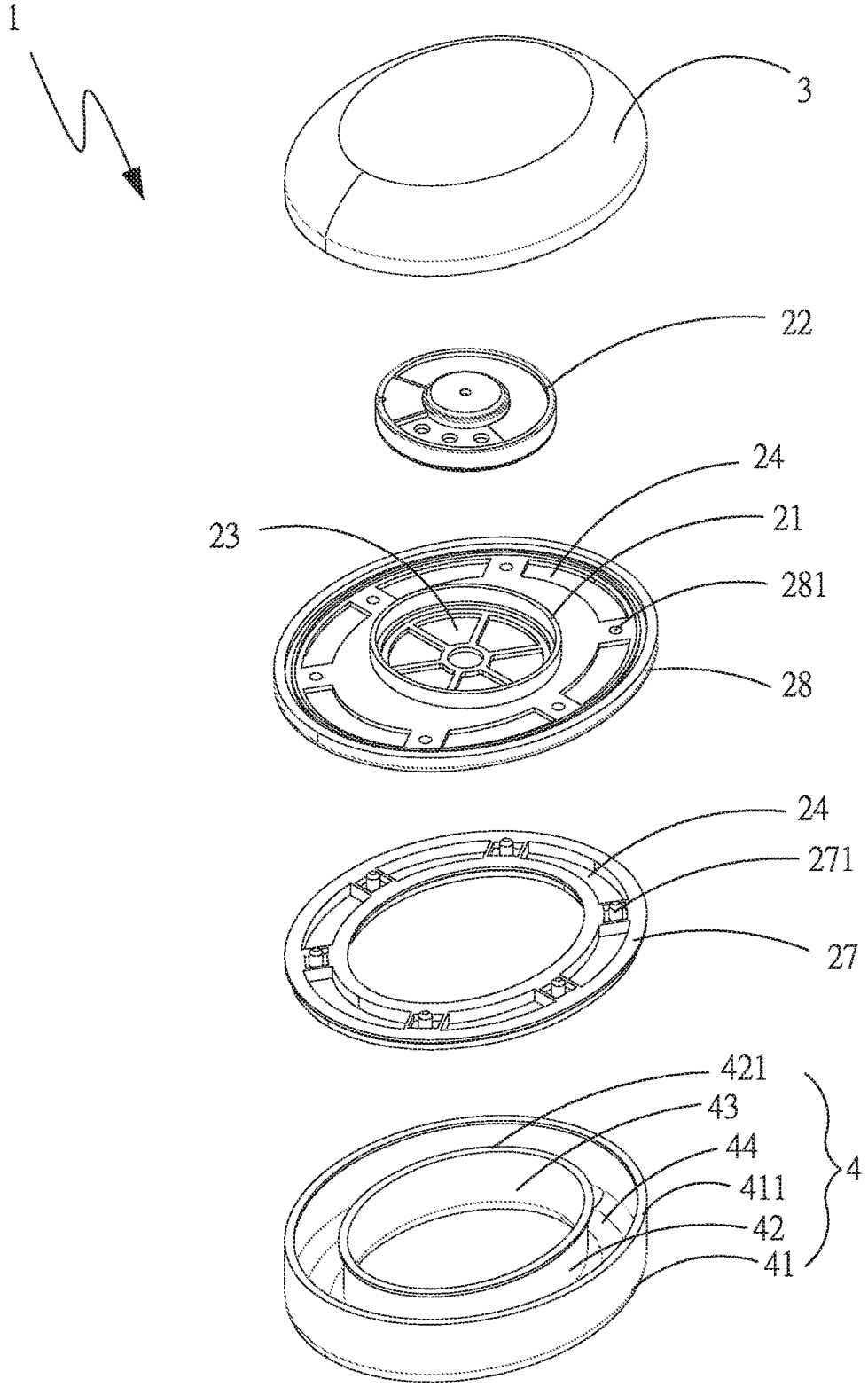
FIG. 6 is another perspective exploded view of the headphone structure of the present invention.
Figure 7:
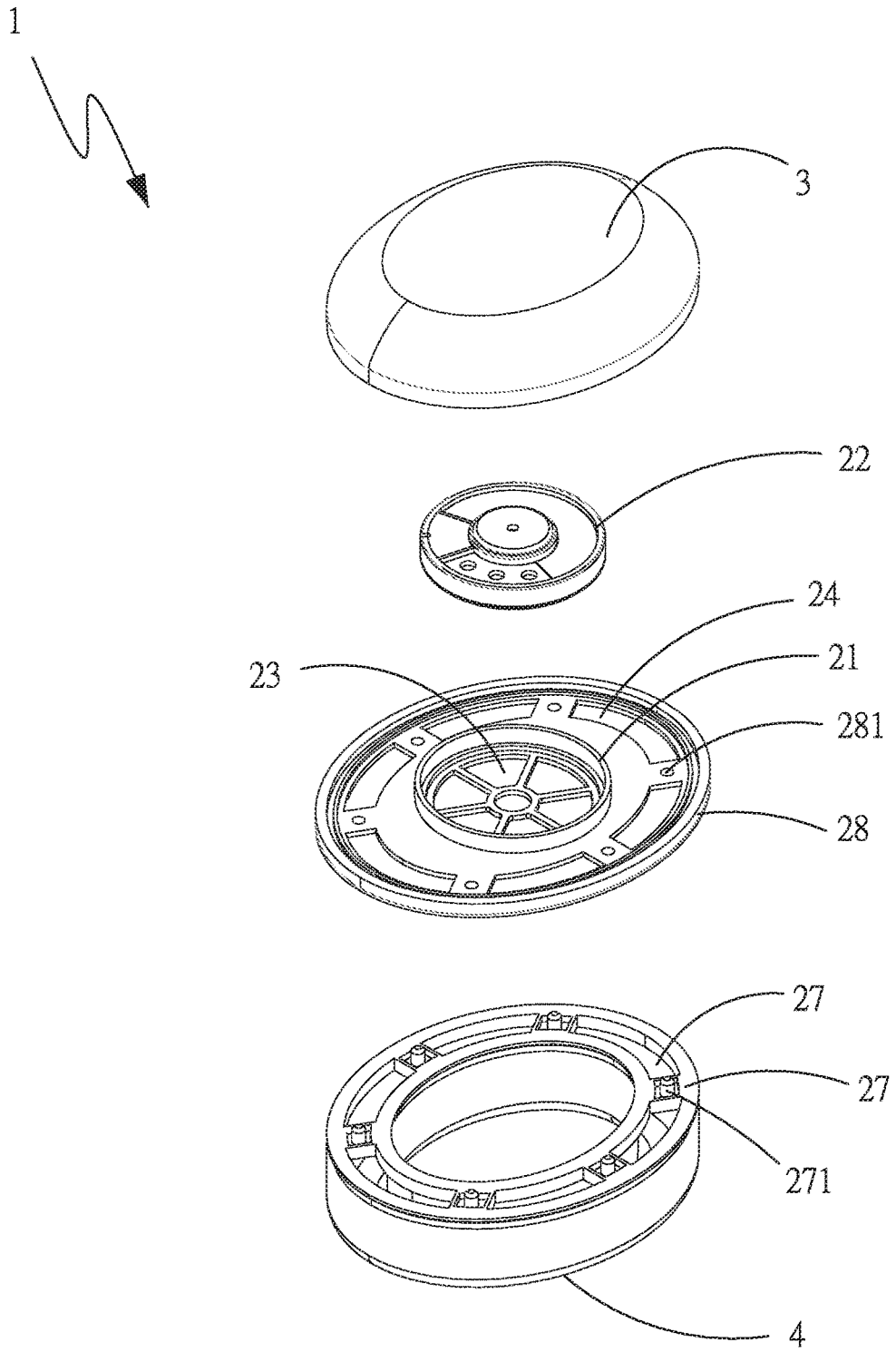
FIG. 7 is yet another perspective exploded view of the headphone structure of the present invention.

Please refer to the foregoing drawings and FIGS. 6 and 7, which are another perspective exploded view, and yet another perspective exploded view of the headphone structure of the present invention. Wherein the main body 2 of the headphone structure 1 can be composed of a front fixing member 27 and a rear fixing member 28. Wherein the front fixing member 27 is formed with the shield interlocking portion 25 on a side edge, the front fixing member 27 is formed with a plurality of convex portions 271 at positions on another side opposite to the shield interlocking portion 25, and the front fixing member 27 is penetrated with the side sound guiding holes 24. The accommodating portion 21 is formed on one side of the rear fixing member 28, the cover interlocking portion 26 is formed on an edge of the same side of the rear fixing member 28 where the accommodating portion 21 is disposed, and the rear fixing member 28 is penetrated with a plurality of holes 281 and the side sound guiding holes 24. Wherein the front fixing member 27 is disposed on a front side of the rear fixing member 28, and the convex portions 271 of the front fixing member 27 are respectively assembled with the holes 281 of the rear fixing member 28. The side sound guiding holes 24 of the front fixing member 27 are disposed in communication with the side sound guiding holes 24 of the rear fixing member 28, the shield 4 is disposed at a position of a front side of the front fixing member 27, and the rear cavity extending space 44 correspondingly communicates with the side sound guiding holes 24. The inner ring interlocking portion 421 as well as the outer ring interlocking portion 411 are assembled with the shield interlocking portion 25 and fix the shield 4 on the front side of the main body 2. The cover 3 is disposed on the rear side of the rear fixing member 28, the rear cavity space 31 is formed between the cover 3 and the rear fixing member 28, and the rear cavity space 31 communicates with the side sound guiding holes 24. The edge of the cover 3 is assembled with the cover interlocking portion 26 and fixed to the rear side of the main body 2 to enable the rear cavity extending space 44 to communicate with the side sound guiding holes 24 and the rear cavity space 31, so that the headphone structure 1 can increase its overall cavity space. While the cavity space is increased, the air compression resistance in the headphone structure 1 can be made smaller, and when the speaker 22 receives a sound source and generates vibration, stroke displacement of the speaker 22 can be effectively enhanced. With the cavity space being increased, air suppression of sound in the headphone structure 1 can be reduced, thereby achieving the headphone structure 1 being capable of transmitting full audio effects and providing full acoustic experience.

Referring to the foregoing drawings and FIG. 7 again, which is yet another perspective exploded view of the headphone structure of the present invention. Wherein the front fixing member 27 can be integrally formed with the shield 4 by double injection molding, so that the side sound guiding holes 24 of the front fixing member 27 are disposed in communication with the side sound guiding holes 24 of the rear fixing member 28. The cover 3 is disposed on the rear side of the rear fixing member 28, the rear cavity space 31 is formed between the cover 3 and the rear fixing member 28, and the rear cavity space 31 communicates with the side sound guiding holes 24 to enable the rear cavity extending space 44 to communicate with the side sound guiding holes 24 and the rear cavity space 31, thereby achieving the headphone structure 1 being capable of transmitting full audio effects and providing full acoustic experience.

It is to be understood that the above description is only preferred embodiments of the present invention and is not used to limit the present invention, and changes in accordance with the concepts of the present invention may be made without departing from the spirit of the present invention, for example, the equivalent effects produced by various transformations, variations, modifications and applications made to the configurations or arrangements shall still fall within the scope covered by the appended claims of the present invention.

What is claimed is:

1. A headphone structure for extending and enhancing resonance, comprising:

a main body, the main body being formed with an accommodating portion at one side and at least one shield interlocking portion and at least one cover interlocking portion on both sides respectively, a speaker being disposed in the accommodating portion, the main body being penetrated with at least one master sound guiding hole and at least one side sound guiding hole and being composed of a front fixing member and a rear fixing member, wherein the shield interlocking portion is formed on one side edge of the front fixing member, the front fixing member is formed with a plurality of convex portions at positions on another side opposite to the shield interlocking portion, and the front fixing member is penetrated with the side sound guiding hole;

a cover, the cover being disposed on a rear side of the main body, a rear cavity space being formed between the cover and the main body, and the rear cavity space communicating with the side sound guiding hole; and a shield, the shield being disposed on a front side of the main body, the shield having an outer ring portion and an inner ring portion connected to each other, a front cavity space being formed by the inner ring portion of the shield, and a rear cavity extending space being formed between the outer ring portion and the inner ring portion for communicating with the side sound guiding hole and the rear cavity space.

2. The headphone structure for extending and enhancing resonance as claimed in claim 1, wherein the main body being penetrated with a plurality of the side sound guiding holes, the master sound guiding hole is formed in the accommodating portion and corresponds to the speaker, and the side sound guiding holes surround the accommodating portion in a mutually spaced manner.

3. The headphone structure for extending and enhancing resonance as claimed in claim 1, wherein an edge of the inner ring portion is formed with an inner ring interlocking portion, an edge of the outer ring portion is formed with an outer ring interlocking portion, and the inner ring interlocking portion as well as the outer ring interlocking portion are assembled with the shield interlocking portion and fix the shield on the front side of the main body.

4. The headphone structure for extending and enhancing resonance as claimed in claim 1, wherein an edge of the cover is assembled with the cover interlocking portion and fixed to the rear side of the main body, and the rear cavity space communicates with the side sound guiding hole.

5. The headphone structure for extending and enhancing resonance as claimed in claim 1, wherein the accommodating portion and the cover interlocking portion are formed on one side of the rear fixing member, and the rear fixing member is penetrated with a plurality of holes and the side sound guiding hole.

* * * * *